US010199132B2

(12) United States Patent
Kimura et al.

(10) Patent No.: US 10,199,132 B2
(45) **Date of Patent: *Feb. 5, 2019**

(54) HIGH STRENGTH CU—NI—CO—SI BASED COPPER ALLOY SHEET MATERIAL AND METHOD FOR PRODUCING THE SAME, AND CURRENT CARRYING COMPONENT

(71) Applicant: DOWA METALTECH CO., LTD., Tokyo (JP)

(72) Inventors: Takashi Kimura, Tokyo (JP); Toshiya Kamada, Tokyo (JP); Weilin Gao, Tokyo (JP); Fumiaki Sasaki, Tokyo (JP); Akira Sugawara, Tokyo (JP)

(73) Assignee: DOWA METALTECH CO., LTD., Tokyo (JP)

( * ) Notice: Subject to any disclaimer, the term of this patent is extended or adjusted under 35 U.S.C. 154(b) by 579 days.

This patent is subject to a terminal disclaimer.

(21) Appl. No.: 14/762,479

(22) PCT Filed: Feb. 10, 2014

(86) PCT No.: PCT/JP2014/053053

§ 371 (c)(1),
(2) Date: Jul. 22, 2015

(87) PCT Pub. No.: WO2014/126047

PCT Pub. Date: Aug. 21, 2014

(65) Prior Publication Data

US 2015/0357074 A1 Dec. 10, 2015

(30) Foreign Application Priority Data

Feb. 14, 2013 (JP) ..... 2013-027172

(51) Int. Cl.

| | |
|---|---|
| ***C22C 9/06*** | (2006.01) |
| ***C22F 1/08*** | (2006.01) |
| ***H01B 1/02*** | (2006.01) |

(52) U.S. Cl.
CPC ..... *H01B 1/026* (2013.01); *C22C 9/06* (2013.01); *C22F 1/08* (2013.01)

(58) Field of Classification Search
CPC .. H01B 1/026; C22C 9/06; C22C 9/10; C22F 1/08
See application file for complete search history.

(56) References Cited

U.S. PATENT DOCUMENTS

| | | | | |
|---|---|---|---|---|
| 7,648,601 | B2 * | 1/2010 | Hasegawa | C22C 9/06 148/682 |
| 9,412,482 | B2 * | 8/2016 | Kamada | H01B 1/026 |

FOREIGN PATENT DOCUMENTS

| | | |
|---|---|---|
| JP | 2008-248333 | 10/2008 |
| JP | 2009-242890 | 10/2009 |

(Continued)

OTHER PUBLICATIONS

JP 2008-248333, Kuwagaki, published Oct. 2008. (machine translation) (Year: 2008).*

*Primary Examiner* — Keith Walker
*Assistant Examiner* — John A Hevey
(74) *Attorney, Agent, or Firm* — Clark & Brody

(57) ABSTRACT

A copper alloy sheet material comprises (by mass %) from 2.50 to 4.00% in total of Ni and Co, from 0.50 to 2.00% of Co, from 0.70 to 1.50% of Si, from 0 to 0.50% of Fe, from 0 to 0.10% of Mg, from 0 to 0.50% of Sn, from 0 to 0.15% of Zn, from 0 to 0.07% of B, from 0 to 0.10% of P, from 0 to 0.10% of REM, from 0 to 0.01% in total of Cr, Zr, Hf, Nb and S, the balance Cu and unavoidable impurities. A number density of coarse secondary phase particles (particle diameter of 5 mm or more) is 10 per $mm^2$ or less. A number density of fine secondary phase particles (particle diameter of from 5 to 10 nm) is $1.0 \cdot 10^9$ per $mm^2$ or more. A Si concentration in the parent phase is 0.10% by mass or more.

3 Claims, 1 Drawing Sheet

(56) References Cited

FOREIGN PATENT DOCUMENTS

| | | |
|---|---|---|
| JP | 2009-242932 | 10/2009 |
| JP | 2011-508081 | 3/2011 |
| JP | 2011-084764 | 4/2011 |
| JP | 2011-231393 | 11/2011 |
| JP | 2011-252188 | 12/2011 |
| JP | 2012-229468 | 11/2012 |
| WO | 2010/064547 | 6/2010 |
| WO | 2011/068134 | 6/2011 |

* cited by examiner

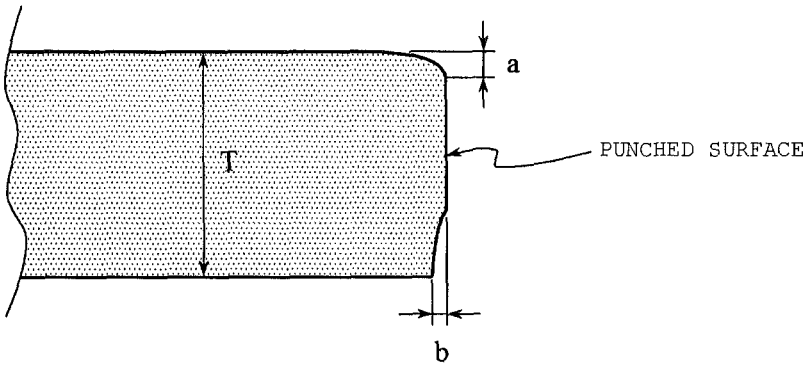
a
T
PUNCHED SURFACE
b

HIGH STRENGTH CU—NI—CO—SI BASED COPPER ALLOY SHEET MATERIAL AND METHOD FOR PRODUCING THE SAME, AND CURRENT CARRYING COMPONENT

TECHNICAL FIELD

The present invention relates to a Cu—Ni—Co—Si based copper alloy sheet material suitable for an electric or electronic member, such as a connector, a lead frame, a relay and a switch, that has a particularly excellent strength level, and a method for producing the same.

BACKGROUND ART

A material that is used as a current carrying component, such as a connector, a lead frame, a relay and a switch, in an electric or electronic member is demanded to have good conductivity for suppressing generation of Joule heat due to electric conduction and is also demanded to have high strength capable of withstanding stress applied on fabrication and operation of an electric or electronic equipment. Furthermore, it is important to have good press punching property in consideration of processing into an electric or electronic member, such as a connector.

In recent years, particularly, there is a tendency of reducing size and weight of an electric or electronic member, such as a connector, and associated thereto, a sheet material of a copper alloy as a material therefor is increasingly demanded for reduced sheet thickness (for example, a sheet thickness of 0.15 mm or less, and further 0.10 mm or less). Accordingly, the strength level and the conductivity level that are demanded for the material are becoming severer. Specifically, such a material is demanded that has a strength level of a 0.2% offset yield strength of 980 MPa or more, and further 1,000 MPa or more in some cases, and a conductivity level of a conductivity of 30% IACS or more.

In addition, associated with the increase of the cases where an electric or electronic member is used in a severe environment, a copper alloy sheet material as a material therefor undergoes a severe requirement in stress relaxation resistance characteristics. Particularly, a connector for an automobile is demanded to have a capability assuming the use under a high temperature environment, and the stress relaxation resistance characteristics is significantly important therefor.

In a consumer-use connector, the size and the terminal pitch are being reduced, and electric conduction is required to be achieved at a blanking surface formed by punching in some cases. In such a purpose, the material is also strongly demanded to have good press punching property.

Representative examples of a high strength copper alloy include a Cu—Be based alloy (such as C17200, Cu-2% Be), a Cu—Ti based alloy (such as C19900, Cu-3.2% Ti) and a Cu—Ni—Sn based alloy (such as C72700, Cu-9% Ni-6% Sn). However, there is an increasing tendency of avoiding a Cu—Be based alloy from the standpoint of cost and environmental load (which may be referred to as a beryllium avoiding tendency). A Cu—Ti based alloy and a Cu—Ni—Sn based alloy have a modulated structure, in which the solid solution elements have a periodical fluctuation in concentration in the parent phase (i.e., a spinodal structure), and thus have high strength but have a low conductivity, for example, approximately from 10 to 15% IACS.

On the other hand, a Cu—Ni—Si based alloy (i.e., a so-called Corson alloy) is receiving attention as a material that has relatively good balance between the strength and the conductivity. This alloy system may provide a sheet material that has a 0.2% offset yield strength of 700 MPa or more while maintaining a relatively high conductivity (from 30 to 50% IACS), for example, by a process based on solution treatment, cold rolling, aging treatment, finishing cold rolling, and low-temperature annealing. However, it is not necessarily easy to provide higher strength with this alloy system.

As a measure for increasing the strength of the Cu—Ni—Si copper alloy sheet material, such general measures have been known as addition of a large amount of Ni and Si, and increase of the finishing rolling ratio (temper treatment) after the aging treatment. The strength may be increased by the increase of the amount of Ni and Si added, but when the amount thereof added exceeds a certain value (for example, approximately 3% for Ni and approximately 0.7% for Si), there is a tendency that the increase in strength is saturated, and it is considerably difficult to achieve a 0.2% offset yield strength of 980 MPa or more.

CITATION LIST

Patent Literatures

PTL 1: WO2011/068134
PTL 2: JP-A-2009-242890
PTL 3: JP-A-2008-248333
PTL 4: JP-A-2011-252188
PTL 5: JP-A-2009-242932
PTL 6: JP-A-2011-508081
PTL 7: JP-A-2011-231393
PTL 8: JP-A-2011-84764

SUMMARY OF INVENTION

Technical Problem

As an improved system of the Cu—Ni—Si based alloy, a Cu—Ni—Co—Si based alloy obtained by adding Co has been known. Co forms a compound with Si as similar to Ni and thus forms an Ni—Co—Si based compound, and two kinds of compounds, i.e., an Ni—Si based compound containing Ni in a larger amount than Co and a Co—Si based compound containing Co in a larger amount than Ni, are formed at the aging temperature. The optimum precipitation temperature of the Ni—Si based compound is approximately 450° C. (which is generally from 425 to 475° C.), whereas the optimum precipitation temperature of the Co—Si based compound is as high as approximately 520° C. (which is generally from 500 to 550° C.), and thus the optimum aging temperature ranges thereof do not conform to each other. Accordingly, for example, in the case where the aging treatment is performed at 450° C. in conformity with the Ni—Si based compound, the precipitation rate of the Co—Si based compound may be insufficient, and in the case where the aging treatment is performed at 520° C. in conformity with the Co—Si based compound, the Ni—Si based compound may be coarse to reduce the peak hardness. Even though the aging treatment is performed at an intermediate temperature, for example, 480° C., the optimum conditions for both the two kinds of precipitates may not be achieved simultaneously.

The Cu—Ni—Co—Si based alloy has a work hardening capability that is not very high in a high processing ratio range. For example, the alloy exhibits large strength increase by working in a low reduction ratio range of 20% or less, but the work hardening increment may be lowered when the rolling ratio is further increased. Accordingly, it is considered that it is difficult to achieve a significantly high strength level by utilizing work hardening in cold rolling.

The effective measures for improving the strength of the Cu—Ni—Co—Si based alloy include a method of utilizing precipitation strengthening with Cr and Zr, which have a very small solid solubility limit in Cu and form a compound with Si, and a method of utilizing solid solution strengthening with Sn and Zn. However, the addition of Cr and Zr tends to form coarse crystalized products and precipitates, and it is difficult to control the precipitation by an ordinary production method. The particles of the coarse crystalized products and precipitates may be dropped off in press working into a connector or the like, and thereby not only the blanking surface is deteriorated, but also the dropped off matters may abrade the mold to increase the maintenance cost of the mold significantly. The particles are liable to be starting points of cracks in bending work and thus are problems in working. On the other hand, the solid solution strengthening with Sn and Zn is effective for enhancing the strength, but the application thereof is restricted due to the reduction in conductivity by the formation of a solid solution thereof.

PTL 1 describes a technique of enhancing the workability of the Cu—Ni—Co—Si based alloy by controlling the texture thereof. There is no particular technique of enhancing the strength, and most of the alloys exemplified have a 0.2% offset yield strength that is within a range of approximately from 700 to 930 MPa. There is an example exhibiting 1,000 MPa, but it is an alloy that has a very high Ni content of 4.9% by mass. The addition of a large amount of Ni may cause deterioration in press punching property due to the formation of coarse precipitates.

PTL 2 describes a technique of enhancing the spring deflection limit of the Cu—Ni—Co—Si based alloy by controlling the number density of the secondary phase particles having a size of from 0.1 to 1 μm. The strength level is as low as a 0.2% offset yield strength of approximately 900 MPa or less.

PTL 3 describes a Cu—Ni—Co—Si based alloy that is suppressed in formation of coarse secondary phase particles by optimizing the conditions in the hot rolling and the solution treatment. The strength level is as low as a 0.2% offset yield strength of approximately from 800 to 900 MPa also in this case.

PTL 4 describes a technique of enhancing the strength and the setting resistance through control of the nano-order precipitates by dividing the aging step performed into two stages. However, a 0.2% offset yield strength of 920 MPa or more is not obtained thereby.

PTL 5 describes that the size of crystal grains of the Cu—Ni—Co—Si based alloy is controlled by using a hot rolling finishing temperature of 850° C. or more and performing an aging treatment and a solution treatment after finishing 85% or more of cold rolling, thereby suppressing fluctuation of the mechanical characteristics. However, there is no example that has an average value of strength exceeding 950 MPa. Most of the examples therein have a fluctuation in strength of 30 MPa or more, which is not necessarily sufficient for providing a high accuracy member. According to the technique in the literature, it is necessary to add a large amount of Cr exceeding 0.2% by mass for providing a strength with a 0.2% offset yield strength of 980 MPa or more including the fluctuation, and in this case, there is a possibility of deteriorating the press punching property.

PTL 6 describes a Cu—Ni—Co—Si based alloy that is enhanced in strength by optimizing the ratios of the elements added. There is no sufficient investigation for the control of precipitates, and Cr is necessarily added for providing a strength with a 0.2% offset yield strength of 980 MPa or more. Furthermore, high strength is obtained by adding a large amount of Sn, but in this case, deterioration in conductivity due to the formation of a solid solution with Sn tends to be a problem.

PTL 7 and PTL 8 describe a Cu—Ni—Co—Si based alloy that achieves such characteristics as a conductivity of 30% IACS or more and a 0.2% offset yield strength of 900 MPa or more by controlling the precipitation of two kinds of compounds, i.e., an Ni—Si based compound and a Co—Si based compound. However, a 0.2% offset yield strength of 980 MPa or more is not obtained thereby.

The invention is to provide a Cu—Ni—Co—Si based copper alloy sheet material that is capable of being produced with a cost equivalent to the ordinary products, and particularly has a very high strength of a 0.2% offset yield strength of 980 MPa or more, and further 1,000 MPa or more, has a conductivity of 30% IACS or more, and preferably 34% or more, and is good in the stress relaxation resistance characteristics and the press workability.

Solution to Problem

The aforementioned objects are achieved by a copper alloy sheet material: having a chemical composition containing from 2.50 to 4.00% in total of Ni and Co, from 0.50 to 2.00% of Co, from 0.70 to 1.50% of Si, from 0 to 0.50% of Fe, from 0 to 0.10% of Mg, from 0 to 0.50% of Sn, from 0 to 0.15% of Zn, from 0 to 0.07% of B, from 0 to 0.10% of P, from 0 to 0.10% of REM (rare earth elements), from 0 to 0.01% in total of Cr, Zr, Hf, Nb and S, the balance of Cu, and unavoidable impurities, all in terms of percentage by mass; containing secondary phase particles present in a parent phase, in which a number density of coarse secondary phase particles having a particle diameter of 5 μm or more is 10 per $mm^2$ or less, and a number density of fine secondary phase particles having a particle diameter of from 5 to 10 nm is $1.0\times10^9$ per $mm^2$ or more; and having an Si concentration in the parent phase of 0.10% by mass or more. The copper alloy sheet material has a very high 0.2% offset yield strength of 980 MPa or more, and further 1,000 MPa or more, in the rolling direction, and has a conductivity of 30% IACS or more.

The REM (rare earth elements) herein include lanthanoid elements, and Y and Sc. The Si concentration in the parent phase (matrix) used herein is a value obtained in the following manner. The Cu parent phase of the specimen is irradiated with an electron beam at an acceleration voltage of 200 kV with an EDS (energy dispersive X-ray spectrometry) equipment attached to TEM (transmission electron microscope), and in the case where the Cu concentration (% by mass) obtained as an EDS analysis result is lower than (100−(actual total percentage by mass of the alloy elements other than Cu)), i.e., the case where the total amount of the alloy elements other than Cu obtained as an EDS analysis result exceeds the actual total content of the elements determined by wet analysis, the EDS analysis value is not used since the value is subjected to influence of the secondary phase particles excessively, and the average value of Si analysis values (% by mass) in EDS analysis results of 10 or more positions in the other cases is designated as the Si concentration (% by mass) in the parent phase of the specimen.

As a method for producing the aforementioned copper alloy sheet material, there is provided a method containing:

a step of heating and maintaining a cast piece of the copper alloy having the aforementioned chemical composition at a temperature of from 1,000 to 1,060° C. for 2 hours or more, and then subjecting the same to hot rolling;

a step of subjecting a sheet material after subjecting to the hot rolling, to cold rolling;

a step of subjecting the sheet material after subjecting to the cold rolling, to a solid solution heat treatment at a temperature of from 900 to 1,020° C.;

a step of subjecting the sheet material after subjecting to the solid solution heat treatment, to a thermal history, in which a period of time where a temperature of the material is in a range of from 600 to 800° C. is maintained for from 5 to 300 seconds, and the material is then quenched at an average cooling rate from 600° C. to 300° C. of 50° C. per second or more; and a step of subjecting the sheet material after subjecting to the thermal history, to an aging treatment at a temperature of from 300 to 400° C., thereby providing a metal microstructure having a number density of fine secondary phase particles having a particle diameter of from 5 to 10 nm of $1.0\times10^9$ per $mm^2$ or more and an Si concentration in the parent phase of 0.10% by mass or more.

After subjecting to the aging treatment, the material may be subjected to finishing cold rolling at a rolling ratio of from 20 to 80%, and after subjecting to the cold rolling, the material may be subjected to low-temperature annealing at a temperature of from 300 to 600° C.

The copper alloy sheet material is significantly useful for producing one of current carrying components including a connector, a lead flame, a relay and a switch, by press punching.

Advantageous Effects of Invention

According to the invention, a Cu—Ni—Co—Si based copper alloy sheet material is provided that has a very high strength of a 0.2% offset yield strength of 980 MPa or more, and further 1,000 MPa or more. The copper alloy sheet material has a high conductivity of 30% IACS or more, and further 34% or more, and is good in the stress relaxation resistance property and the press workability. Furthermore, the aforementioned high strength may be obtained with a production cost that is equivalent to an ordinary Cu—Ni—Co—Si based copper alloy sheet material.

BRIEF DESCRIPTION OF DRAWING

FIG. 1 is an illustration that schematically shows a cross sectional shape after punching.

DESCRIPTION OF EMBODIMENTS

As a result of investigations, the present inventors have found the following knowledge/

(a) In the Cu—Ni—Co—Si based copper alloy sheet material, when the number density of the fine secondary phase particles having a particle diameter of from 5 to 10 nm is $1.0\times10^9$ per $mm^2$ or more, significant increase of the strength due to precipitation strengthening is exhibited.

(b) In the Cu—Ni—Co—Si based copper alloy sheet material, when the Si concentration in the parent phase is 0.10% by mass or more, the work hardening capability in a high reduction ratio range is significantly improved, which is considerably advantageous for the enhancement of the strength utilizing the work hardening in cold rolling.

(c) For sufficiently ensuring the number density of the fine secondary phase particles, it is considerably effective to subject, after the solid solution heat treatment, to a thermal history, in which a period of time where the temperature of the material is in a range of from 600 to 800° C. is maintained for from 5 to 300 seconds, and the material is then quenched at an average cooling rate from 600° C. to 300° C. of 50° C. per second or more, and to subject an aging treatment at a low temperature of from 300 to 400° C. By the low temperature aging, the Si concentration in the parent phase may be 0.10% by mass or more.

(d) By subjecting the cast piece to heating and maintaining at a temperature of from 1,000 to 1,060° C. for 2 hours or more, and then subjecting the same to hot rolling, and then subjecting the same to a solid solution heat treatment, the number density of the coarse secondary phase particles having a particle diameter of 5 μm or more may be suppressed to 10 per $mm^2$ or less before the aging treatment. According thereto, the number density of the fine secondary phase particles may be sufficiently ensured, and the press punching property may also be improved.

The invention has been completed based on the knowledge.

Secondary Phase Particles

A Cu—Ni—Co—Si based alloy shows a metal microstructure having secondary phase particles present in a parent phase (matrix) formed of fcc crystals. The secondary phase referred herein includes a crystallized phase formed in solidification in the casting process and a precipitated phase formed in the subsequent process, and in this alloy, the secondary phase is constituted mainly by a Co—Si intermetallic compound phase and a Ni—Si intermetallic compound phase. Two kinds of particles having the following particle diameter ranges are defined in the secondary phase particles observed in the Cu—Ni—Co—Si based alloy herein.

(i) Coarse Secondary Phase Particles

The coarse secondary phase particles have a particle diameter exceeding 5 μm and are formed mainly of particles of the secondary phase formed in solidification in the casting process that remain without formation of a solid solution in the subsequent process. The coarse secondary phase particles do not contribute to the enhancement of strength. The coarse secondary phase particles remaining in a product are dropped off due to gouges on press punching to deteriorate the cross sectional shape, and the particles thus dropped off abrade the mold. The particles are liable to be starting points of cracks in bending work. As a result of various investigations, it has been found that when the amount of the coarse secondary phase particles present therein is suppressed to a number density of 10 per $mm^2$ or less, the material may be applied to mass production of an electric or electronic member, such as a connector, having a reduced size. The number density thereof is more preferably 5 per $mm^2$ or less. The number density of the coarse secondary phase particles may be measured in such a manner that the rolled surface of the sheet material as the measuring object is subjected to electrochemical polishing to dissolve only the Cu matrix, and the number of the secondary phase particles exposed on the surface is measured with SEM (scanning electron microscope). The particle diameter herein means the diameter of the minimum circle surrounding the particle.

(ii) Fine Secondary Phase Particles

The fine secondary phase particles have a particle diameter of 5 nm or more and 10 nm or less, and are formed through the aging treatment. The fine secondary phase particles have considerably large contribution to the enhancement of strength. It is ordinarily known that a fine precipitate having a particle diameter of 10 nm or less in a copper alloy has large contribution to the enhancement of strength, and in a Cu—Ni—Co—Si based alloy, for example, it is considered that high strength may be obtained by sufficiently ensuring a density of a precipitate of approximately from 2 to 10 nm. However, it has been found that for achieving a considerably high strength level of a 0.2% offset yield strength of 980 MPa or more, it is necessary to ensure sufficiently the amount of particles having a particle diameter of from 5 to 10 nm, which have large contribution particularly to the hardness among the particles of approximately from 2 to 10 nm. In the invention, accordingly, the amount of the fine secondary phase particles within the narrow particle diameter range of from 5 to 10 nm is defined. According to the detailed investigations made by the inventors, it is significantly effective that the amount of the fine secondary phase particles present is $1.0\times10^9$ per $mm^2$ or more, and it is more effective that the amount is $2.0\times10^9$ per $mm^2$ or more, and may be managed to $2.5\times10^9$ per $mm^2$ or more. The upper limit of the amount thereof present may not be particularly determined since it is restricted by the Ni content, the Co content, the Si content and the definition of the Si concentration in the parent phase described later, and is generally in a range of $5.0\times10^9$ per $mm^2$ or less. The number density of the fine secondary phase particles may be measured in such a manner that a specimen collected from the sheet material as the measuring object is observed with TEM (transmission electron microscope), and the number of the secondary phase particles having a particle diameter of from 5 to 10 nm is counted. The particle diameter herein means the diameter of the minimum circle surrounding the particle.

Chemical Composition

The component elements of the Cu—Ni—Co—Si based alloy as the object of the invention will be described. The percentage for the alloy elements shown below means percentage by mass unless otherwise indicated.

Ni and Co are elements that form a Ni—Si precipitate and a Co—Si precipitate respectively to enhance the strength and the conductivity of the copper alloy sheet material. The strength is further enhanced by the synergistic effect of the two kinds of precipitates present. The total amount of Ni and Co is necessarily 2.50% or more. When the amount is less than the value, a sufficient precipitation hardening capability is not obtained. It is more effective that the amount is 3.00% or more. However, the increase of the content of Ni and Co may raise the crystallization and precipitation temperature of the Si compound, which may be a factor promoting a coarse secondary phase on casting and the like. The secondary phase thus formed excessively is difficult to be sufficiently dissolved by the heating and maintaining of the cast piece described later. For controlling the amount of the coarse secondary phase particles to the prescribed number density shown above, it is effective to restrict the total amount of Ni and Co to 4.00% or less.

In the invention, particularly, fine dispersion of the Co—Si precipitate is utilized to achieve high strength. Co has a small solid solubility limit in Cu as compared to Ni and thus may increase the amount of the precipitate formed as compared to the case where the same amount of Ni is added. As a result of various investigations, it is important to ensure a content of Co of 0.50% or more, and more preferably 0.70% or more. Co is metal having a higher melting point than Ni, and therefore when the Co content is too large, the formation of a solid solution in the solid solution heat treatment described later may be insufficient, and Co that does not form a solid solution is not used for the formation of the Co—Si precipitate effective for enhancing the strength, but is wasted. When a large amount of Co is added, the allowable range of the Ni content is narrowed to provide a possibility that the hardening by the Ni—Si precipitate may not be sufficiently exhibited. Furthermore, the increase of the Co content promotes the formation of a coarse secondary phase in solidification, which may adversely affect the press punching property and the bend formability. Due to these factors, the Co content is preferably 2.00% or less, and more preferably 1.80% or less. The Ni content may not be necessarily determined particularly since it is restricted by the total amount of Ni and Co described above, and may be generally set in a range of from 1.00 to 3.00%.

Si is an element that is necessary for forming the Ni—Si precipitate and the Co—Si precipitate. The Ni—Si precipitate is considered to be a compound that is formed mainly of $Ni_2Si$, and the Co—Si precipitate is considered to be a compound that is formed mainly of $Co_2Si$. In the invention intending considerably high strength, Si also has the important function of enhancing the work hardening capability of the parent phase. It is considered that Si forming a solid solution in the Cu parent phase reduces the stacking fault energy and suppresses the occurrence of cross-slip, and thereby Si exhibits a function of enhancing the work hardening capability. Si forming a solid solution is also effective for improving the stress relaxation resistance property. For exhibiting these functions of Si sufficiently, it is desired to ensure an Si content of 0.70% or more, and more preferably 0.80% or more. On the other hand, the addition of excessive Si not only achieves less contribution to the strength, but also provides such problems as the increase of production cost due to the increase of the solution temperature, and the deterioration of the press punching property due to the formation of coarse precipitates. The Si content is desirably 1.50% or less, and may be managed to 1.20% or less.

As additional useful element, at least one kind of Fe, Mg, Sn, Zn, B and P may be contained depending on necessity. Fe has a function of enhancing the strength due to the formation of an Fe—Si compound, Mg is effective for enhancing the stress relaxation resistance property, Sn has a function of enhancing the strength due to solid solution strengthening, Zn has a function of improving the solderability of the copper alloy sheet material and the castability, B has a function of forming a fine cast structure, and P exhibits an effect of enhancing the hot workability due to the deoxidation function. REM (rare earth elements), such as Ce, La, Dy, Nd and Y, are effective for forming fine crystal grain and dispersing precipitates. For exhibiting these functions sufficiently, it is effective to ensure the respective contents thereof of 0.01% or more (0.01% or more in total for REM). However, when the contents of these elements are excessive, there may be cases where the conductivity is lowered, and the hot workability or the cold workability is deteriorated. In the case where these elements are contained, the contents are preferably 0.50% or less for Fe, 0.10% or less for Mg, 0.50% or less for Sn, 0.15% or less for Zn, 0.07% or less for B, 0.10% or less for P, and 0.10% or less for REM. The total content of these elements is preferably 0.50% or less, and more preferably 0.40% or less.

The contents of elements, Cr, Zr, Hf, Nb and S, are preferably suppressed as low as possible. There may be cases where these elements are added as an alloy element to various kinds of copper alloy. Even in the case where these elements are not intentionally added, these elements are mixed in raw materials, and an ordinary copper alloy is allowed to contain these elements to a certain extent. In the invention, however, the contents of these elements are strictly limited in consideration of the necessity of imparting good press workability and the necessity of ensuring the amount of Si forming a solid solution. Specifically, when Cr, Zr, Hf, Nb and S are present in the Cu—Ni—Co—Si based alloy, it is liable to be difficult to suppress the formation of coarse crystalized products and precipitates due to the formation of Si compounds and the occurrence of biphasic separation of the liquid phase, and thereby the press punching property may be adversely affected in some cases. Furthermore, it is liable to be difficult to ensure sufficiently the Si concentration in the parent phase, and the effect of improving the work hardening capability of Si may not be exhibited in such a case. As a result of various investigations, the total content of Cr, Zr, Hf, Nb and S is preferably managed to 0.01% or less, and more preferably 0.005% or less.

Si Concentration in Parent Phase

In an ordinary Cu—Ni—Co—Si based alloy, it is a common procedure to form a microstructure of the material that maximizes the precipitation state for enhancing the conductivity and increasing the strength. Specifically, the microstructure of the material and the precipitation are controlled to reduce the Si amount in the parent phase as low as possible. According to the investigations made by the inventors, however, the work hardening capability may be considerably enhanced in a processing ratio range exceeding 20% by making Si present as a solid solution to some extent in the parent phase of the Cu—Ni—Co—Si based alloy. It is considered that Si forming a solid solution in the parent phase reduces the stacking fault energy to form a large amount of stacking faults in the initial stage of processing, and thereby a microstructure of the material state that prevents cross slip from occurring is formed to enhance the resistance to subsequent working. This function of Si largely improves the work hardening capability, which is the weak point of a Cu—Ni—Co—Si based alloy, and thus the strength characteristics that have not yet been achieved are realized. Si forming a solid solution also has a function of improving the stress relaxation resistance property. Si forming a solid solution is a negative factor for the enhancement of conductivity, but by combining the control of the secondary phase particles described above, a considerably high strength level is achieved without large deterioration in conductivity.

Specifically, the Si concentration in the parent phase is necessarily 0.10% by mass or more, more preferably 0.15% by mass or more, and further effectively 0.20% by mass or more. When the Si amount in the parent phase is increased, the conductivity is lowered associated thereto while reducing the contribution thereof to the work hardening capability. The upper limit of the Si concentration in the parent phase may be controlled in consideration of the balance between the desired conductivity and strength characteristics. The upper limit of the Si concentration in the parent phase may not be necessarily determined since the Si concentration is restricted by the necessity of ensuring the amount of the fine secondary phase particles described above, and for example, for ensuring a conductivity of 30% IACS or more, the Si concentration in the parent phase is preferably in a range of 0.60% by mass or less, and may be managed to a range of 0.50% by mass or less, and further 0.40% by mass or less.

Average Crystal Grain Diameter

A smaller average crystal grain diameter is advantageous for enhancing the strength due to crystal grain boundary strengthening, but a too small average crystal diameter causes deterioration of the stress relaxation resistance property. Specifically, for example, when the average crystal grain diameter is 5 μm or more in the final sheet material, such stress relaxation resistance property that are sufficient for the purpose of a connector are apt to be obtained. The average crystal grain diameter is more preferably 8 μm or more. On the other hand, a too large average crystal grain diameter provides less contribution to the crystal grain boundary strengthening, and thus the average crystal grain diameter is preferably in a range of 30 μm or less, and more preferably 20 μm or less. The final average crystal grain diameter is substantially determined by the crystal grain diameter in the stage before the aging treatment. Accordingly, the average crystal grain diameter may be controlled by the solid solution heat treatment described later. The average crystal grain diameter may be in a range of from 5 to 30 μm according to the solid solution heat treatment condition described later, and thus the average crystal grain diameter may not be necessarily determined herein. The case of a too small average crystal grain diameter means that the solute elements do not sufficiently form a solid solution after the solution treatment, and therefore, the aforementioned requirements for the fine secondary phase particles are generally not satisfied in this case. The average crystal grain diameter may be measured by observing the metal microstructure on the cross sectional surface obtained by polishing the rolled surface and measuring according to the Intercept Method of JIS H0501. In this case, the twin boundary is not considered as the crystal grain boundary.

Characteristics

A material applied to an electric or electronic member, such as a connector, necessarily has a strength that prevents buckling or deformation from occurring due to the stress load on inserting the terminal portion (insertion portion) of the member. In particular, there is a further severe requirement to the strength level for applying to a member having a reduced size and a reduced thickness. The copper alloy sheet material according to the invention exhibits a considerably high strength of a 0.2% offset yield strength of 980 MPa or more, and may be controlled to have a high strength with 1,000 MPa or more. The high strength copper alloy sheet material is significantly advantageous to the future needs of further reduction in size and thickness of an electric or electronic member.

A current carrying component, such as a connector, is increasingly demanded to have a high conductivity as compared to the ordinary products, for dealing with a high integration degree, a high mounting density and a large electric current of an electric or electronic equipment. Specifically, the current carrying components is demanded to have a conductivity of 30% IACS or more, and more preferably 34% IACS or more.

Production Method

The copper alloy sheet material may be produced through a process including heat treatment 1, hot rolling, cold rolling, heat treatment 2, and aging treatment. The heat treatment 1 herein is a step of heating and maintaining a cast piece at a high temperature. The heat treatment 2 is a step of applying a special thermal history including a solid solution heat treatment and a preliminary heat treatment for inducing precipitation of a Co—Si compound on aging. The aging treatment is performed at a low temperature range, which is a characteristic feature thereof. After the aging treatment, finishing cold rolling may be performed, and thereafter, low-temperature annealing may be performed. Examples of the process include a process including melting and casting, hot rolling, heat treatment 1, cold rolling, heat treatment 2, aging treatment, finishing cold rolling, and low-temperature annealing. Examples of the production conditions in the steps are shown below.

Melting and Casting

A copper alloy raw material is melted in the similar manner as in an ordinary melt production method for a copper alloy, and then a cast piece may be casted by continuous casting, a semi-continuous casting or the like. For preventing oxidation of Co and Si from occurring, it is preferred that the molten metal is covered with wood charcoal or carbon, or the material is melted in a chamber under an inert gas atmosphere or under vacuum.

Heating and Maintaining of Cast Piece

After casting, the cast piece is heated and maintained at a temperature of from 1,000 to 1,060° C. According to the procedure, a coarse crystalized phase and a coarse precipitate phase formed on casting are homogenized. The heating and maintaining temperature is more preferably from 1,020 to 1,060° C. The heating and maintaining time may be set in a range of from 2 to 6 hours depending on the state of the solidification structure (casting method). The temperature that exceeds 1,060° C. is not preferred since there is a possibility that the material is melted due to fluctuation of the operation conditions. For this heating treatment, a heating process in the hot rolling as the subsequent step may be used.

Hot Rolling

The cast piece having been subjected to the heating and maintaining is then subjected to hot rolling. The hot rolling condition may be in accordance with the ordinary method. For example, the cast piece is heated to a temperature of from 1,000 to 1,060° C., then hot-rolled at a reduction ratio of from 85 to 97%, and then cooled with water. The rolling temperature of the final pass is preferably 700° C. or more.

The rolling ratio is shown by the following expression (1).

$$\text{reduction ratio } R\ (\%)=(h_0-h_1)/h_0\times 100 \quad (1)$$

In the expression, $h_0$ represents the sheet thickness before rolling (mm), and $h_1$ represents the sheet thickness after rolling (mm).

Cold Rolling

After the hot rolling, cold rolling is appropriately performed to reduce the sheet thickness. Plural cold rolling operations may be performed with intermediate annealing intervening therebetween depending on the target sheet thickness. In the case where the intermediate annealing is performed, it is preferably performed at a temperature of from 350 to 600° C., and more preferably 550° C. or less, from the standpoint of preventing coarse secondary phase particles from being formed. The annealing time may be, for example, in a range of from 5 to 20 hours.

Solid Solution Heat Treatment

In general, a solution treatment is performed before an aging treatment. The major object of the solution treatment is recrystallization and resolution of solute elements. In an ordinary solution treatment, a material is maintained at a high temperature where a precipitate undergoes resolution, and then quenched to ordinary temperature for preventing unintended precipitation from occurring in the cooling process. The solution treatment often includes the cooling process.

According to the invention, a process for a solution treatment is necessarily performed since age hardening is utilized. The heating process and the high temperature maintaining process may be performed under the same conditions as in the ordinary solution treatment. However, the special thermal history described later is applied in the cooling process, and therefore, the portion corresponding to the heating process and the high temperature maintaining process of the ordinary solution treatment is referred to as a solid solution heat treatment herein. Specifically, the sheet material after subjecting to the cold rolling is heated and maintained at a temperature of from 900 to 1,020° C., and more preferably from 950 to 1,020° C. A too low maintaining temperature is not preferred since the recrystallization and the resolution of solute elements do not sufficiently proceed, or a prolonged period of time of maintaining is required therefor. A too high maintaining temperature is liable to form coarse crystal grains. More specifically, the maintaining time may be determined corresponding to the heating temperature, so as to provide an average crystal grain diameter of from 5 to 30 μm, and more preferably from 8 to 20 μm. In general, the optimum maintaining time may be found in a range of from 0.5 to 10 minutes. While the coarse crystalized phase may not be completely formed into a solid solution by the heating and maintaining, the solute elements are formed into a solid solution in the parent phase to such an extent that sufficient precipitation occurs by the aging treatment, as similar to the ordinary solution treatment.

The precursor treatment described later may be performed by utilizing the cooling process of the solid solution heat treatment, but a continuous heat treatment equipment is required therefor. The continuous heat treatment is suitable for mass production, and in the case where the continuous heat treatment may not be performed, the material may be quenched to ordinary temperature after the solid solution heat treatment (which corresponds to the ordinary solution treatment).

Precursor Treatment after Solid Solution Heat Treatment

In a Cu—Ni—Co—Si based alloy, two kinds of precipitates, i.e., a Ni—Si precipitate and a Co—Si precipitate, may contribute to the enhancement of strength. However, these have optimum precipitation temperatures and times that are different from each other (i.e., there are differences between them). The optimum precipitation temperature is approximately 450° C. for the Ni—Si precipitate and approximately 520° C. for the Co—Si precipitate. Accordingly, it is generally difficult to utilize maximally age hardening of these two kinds of precipitates simultaneously. According to the investigations made by the inventors, however, it has been found that when the material having been subjected to the aforementioned solid solution heat treatment is maintained in a temperature range of from 600 to 800° C. for from 5 to 300 seconds, such a microstructure of the material state is obtained that the Co—Si compound is apt to be precipitated by the low-temperature aging treatment described later. In the temperature range of from 600 to 800° C., the Ni—Si compound is substantially not precipitated, and as for the Co—Si compound, precipitation thereof occurs in this temperature range, but this temperature range is higher than the optimum precipitation temperature thereof. It is the current situation that the mechanism providing the microstructure of the material state that is suitable for the precipitation of the Co—Si compound in this temperature range is unclear, and it may be expected that when the parent phase having the solute atoms having been sufficiently formed into a solid solution is exposed to the temperature range for a short period of time, embryos formed mainly of Co and Si are formed and become a driving force for the precipitation of the Co—Si compound in the low-temperature aging treatment described later. The formation of the embryos may be considered as a precursor phenomenon of the precipitation of the Co—Si compound. Accordingly, the maintaining in a temperature range of from 600 to 800° C. is referred to as a precursor treatment herein.

The precursor treatment is performed by subjecting the sheet material having been subjected to the aforementioned solid solution heat treatment in the metal microstructure state having the solute elements sufficiently formed into a solid solution, to a thermal history, in which the period of time where the temperature of the material is in a range of from 600 to 800° C. is maintained for from 5 to 300 seconds, and the material is then quenched at an average cooling rate from 600° C. to 300° C. of 50° C. per second or more. When the maintaining time at from 600 to 300° C. is too long, the Co—Si compound or the Ni—Si compound is formed to prevent the driving force for the precipitation of the Co—Si compound from being exhibited sufficiently in the aging treatment. At a temperature higher than 800° C., the embryos are insufficiently formed. When the maintaining time at from 600 to 800° C. is too short, the embryos are insufficiently formed, and when the maintaining time is too long, the Co—Si compound may be precipitated to form coarse particles, which make the enhancement of strength insufficient. A particularly effective condition may include a condition, in which the period of time where the temperature is in a range of from 650 to 750° C. is maintained from 20 to 300 seconds.

The precursor treatment is effectively performed by utilizing the cooling process of the solid solution heat treatment with the continuous heat treatment equipment as described above. In this case, it is preferred that the material is cooled from the maintaining temperature of the solid solution heat treatment to 800° C. at an average cooling rate of 50° C. per second or more, and then subjected to the precursor treatment. The material having been subjected to an ordinary solution treatment (solid solution treatment) may be reheated for subjecting to the precursor treatment. In this case, it is preferred that the cooling rate of from 600 to 300° C. in the cooling process after the solution treatment is 50° C. per second or more, and the heating rate of from 300 to 600° C. in the heating process on reheating is 50° C. per second or more, thereby preventing the Ni—Si compound from being formed in the heating process as much as possible.

Aging Treatment

The sheet material having been subjected to the solid solution heat treatment and the thermal history of the precursor treatment is subjected to an aging treatment. In general, a Cu—Ni—Co—Si based alloy is subjected to an aging treatment at approximately 520° C., but the aging treatment in the invention is performed in a low-temperature range of from 300 to 400° C., which is not ordinarily used. It is considered that in the precursor treatment as the preceding process, the free energy relating to nuclear formation of the Co—Si compound particles is largely reduced to provide such a microstructure state that the Co—Si compound is considerably apt to be precipitated, and thus aging may be performed in such a low-temperature range. It has been found that according to the low-temperature aging treatment, the fine secondary phase particles having a particle diameter of from 5 to 10 nm, which most contribute to the enhancement of strength, are formed in a large amount. It is considered that this is because (i) the producible amount of the secondary phase particles is increased in an equilibrium manner since the low-temperature aging treatment is a heat treatment in a temperature range with a narrower solid solubility limit than the ordinary treatment, and thus the precipitation amount may be increased by sufficiently ensuring the aging time, and (ii) the Co—Si secondary phase particles inherently having a high precipitation temperature are suppressed from growing in a low-temperature range of from 300 to 400° C. due to the small free energy of the growth of precipitate, and thus a large amount of fine secondary phase particles having a particle diameter that is restricted to 10 nm or less are formed. It has been confirmed that the Ni—Si compound is also precipitated by the low-temperature aging treatment. Accordingly, the precipitation hardening phenomenon with the two kinds of precipitates, which has been ordinarily difficult, is thus achieved.

On determining the aging treatment condition, such a condition is used that the number density of the fine secondary phase particles having a particle diameter of from 5 to 10 nm is $1.0\times10^9$ per $mm^2$ or more, and the Si concentration in the parent phase is 0.10 or more, after the aging treatment. The diffusion rate of atoms is lower than an ordinary aging treatment due to the low aging treatment temperature of from 300 to 400° C. Accordingly, the allowable range of the aging time for making a suitable amount of Si as a solid solution remaining in the parent phase is enhanced, thereby enabling the control of the Si concentration in the parent phase. The optimum aging time may be found in a range of from 3 to 10 hours.

As an index for determining the optimum aging condition, the following expression (2) may be exemplified.

$$0.60 \leq EC\text{age}/EC\text{max} \leq 0.80 \quad (2)$$

In the expression, ECmax represents the maximum conductivity that is obtained in the case where a heat treatment is performed in a temperature range of from 400 to 600° C. with an interval of 50° C. for 10 hours, and ECage represents the conductivity after the aging treatment. By using ECage/ECmax of 0.60 or more, the precipitation amount is sufficiently ensured, which is advantageous for the improvement of the strength and the conductivity. By using ECage/ECmax of 0.80 or less, the Si concentration in the parent phase is sufficiently ensured, which is advantageous for the improvement of the work hardening capability.

Finishing Cold Rolling

It is considerably advantageous to subject the sheet material having been subjected to the aging treatment, to finishing cold rolling at a reduction ratio of from 20 to 80%, for achieving significant enhancement of the strength. The work hardening is exhibited due to the Si concentration in the parent phase that has been ensured to the prescribed extent in the aging treatment as the preceding process, thereby realizing a super high strength. When the reduction ratio is 20% or more, the enhancement of the work hardening capability with Si as a solid solution present in the parent phase becomes conspicuous. The reduction ratio is more effectively 25% or more, and further effectively 30% or more. However, when the reduction ratio is increased, the increase of the strength is saturated, whereas deterioration of the stress relaxation resistance property and deterioration of the bend formability may occur, and the finishing reduction ratio is necessarily determined property in consideration of the purpose. In the case where the material is used in a member where the stress relaxation resistance property and the bend formability are important, the reduction ratio is necessarily 80% or less, and more preferably 60% or less.

Low-Temperature Annealing

After the finishing cold rolling, low-temperature annealing is preferably performed for the purpose of the enhancement of the strength due to low-temperature annealing hardening, the reduction of the residual stress in the copper alloy sheet material, and the enhancement of the spring deflection limit and the stress relaxation resistance property. The heating temperature is determined in a range of from 300 to 600° C. According to the procedure, the residual stress inside the sheet material is reduced, which may also enhance the conductivity. When the heating temperature is too high, the material is softened in a short period of time, and thereby fluctuation in characteristics may occur in both a batch process and a continuous process. When the heating temperature is too low, on the other hand, the aforementioned effect of improving the characteristics is not sufficiently obtained. The heating time (the period of time where the temperature of the material is in a range of from 300 to 600° C.) is preferably 5 seconds or more, and a favorable results may be generally obtained in one hour or less. For preventing the fine secondary phase particles formed in the aging treatment from becoming coarse, the low-temperature annealing that is performed at a temperature exceeding 400° C. is preferably performed in 2 hours or less.

Example

A copper alloy having the chemical composition shown in Table 1 was melted with a high frequency induction furnace to provide a cast piece having a thickness of 60 mm. The cast piece was heated and maintained in a heating furnace for a hot rolling process and then subjected to hot rolling. The heating and maintaining was at 1,030° C. for 3 hours except for the some cases. The hot rolling was performed in such a manner that the cast piece was rolled to a thickness of 10 mm at a final pass temperature of from 700 to 800° C. and then cooled with water at a cooling rate of 10° C. per second or more. An oxidized scale on the surface of the hot rolled sheet was removed by surface cutting. Thereafter, a cold rolled material was produced by the process including cold rolling at a reduction ratio of 82%, intermediate annealing at 500° C. for 10 hours, acid cleaning, and cold rolling, in this order. The reduction ratio in the cold rolling after the intermediate annealing was controlled in such a manner that the final sheet thickness after the finishing cold rolling (i.e., the sheet thickness of the test material described later) was always 0.15 mm.

The cold rolled material was subjected to a solid solution heat treatment by heating and maintaining at the temperature for the period of time shown in Table 2, and then subjected to a thermal history by immersing in a salt bath to maintain the material at the temperature for the period of time after the solid solution treatment shown in Table 2, and then cooled with water. The solid solution heat treatment was performed under such a condition that the average crystal grain diameter became from 5 to 30 μm except for the some cases. The average crystal grain diameter employed is a value determined by the Intercept Method of JIS H0501 for the metal microstructure obtained by polishing the rolled surface. The maintaining at the prescribed temperature and the cooling with water after the solid solution heat treatment correspond to the aforementioned precursor treatment. The average cooling rate of from the maintaining temperature of the solid solution heat treatment with a salt bath to 800° C. was 15° C. per second or more. The average cooling temperature of from 600 to 300° C. by cooling with water was 15° C. per second or more.

The sheet material having been subjected to the thermal history was subjected to an aging treatment. The temperature and the time therefor were determined to satisfy the expression (2) corresponding to the alloy composition except for the some cases. After the aging treatment, the material was subjected to finishing cold rolling at a reduction ratio shown in Table 2 to provide a sheet thickness of 0.15 mm, and then subjected to low-temperature annealing at 400° C. for 1 minute, thereby providing a copper alloy sheet material (test material). The production conditions are shown in Table 2.

TABLE 1

| | | Chemical composition (% by mass) | | | | | |
|---|---|---|---|---|---|---|---|
| Class | No. | Cu | Ni | Co | Si | Others | Ni + Co |
| Example of Invention | 1 | balance | 2.75 | 1.05 | 1.12 | — | 3.80 |
| | 2 | balance | 2.70 | 0.85 | 0.88 | Mg: 0.08, B: 0.05 | 3.55 |
| | 3 | balance | 2.55 | 1.20 | 0.95 | — | 3.75 |
| | 4 | balance | 2.55 | 1.00 | 0.85 | Sn: 0.32 | 3.55 |
| | 5 | balance | 2.40 | 1.30 | 0.92 | Zn: 0.08, P: 0.01 | 3.70 |
| | 6 | balance | 2.35 | 1.25 | 0.95 | Mg: 0.08, REM: 0.06 | 3.60 |
| | 7 | balance | 2.35 | 1.25 | 0.87 | — | 3.60 |
| | 8 | balance | 2.35 | 1.45 | 1.01 | Zn: 0.13 | 3.80 |
| | 9 | balance | 2.05 | 1.45 | 0.83 | Fe: 0.35 | 3.50 |
| | 10 | balance | 2.05 | 1.20 | 0.90 | Sn: 0.28, P: 0.05 | 3.25 |
| | 11 | balance | 1.90 | 1.35 | 0.82 | — | 3.25 |
| | 12 | balance | 1.80 | 1.70 | 0.86 | — | 3.50 |
| | 13 | balance | 2.25 | 1.55 | 0.92 | Zr: 0.005, S: 0.001 | 3.80 |
| | 14 | balance | 2.00 | 1.25 | 0.80 | Cr: 0.002, Nb: 0.001, Hf: 0.001 | 3.25 |
| | 15 | balance | 2.35 | 1.25 | 0.80 | Mg: 0.06 | 3.60 |
| | 16 | balance | 2.40 | 1.25 | 0.95 | Sn: 0.32 | 3.65 |
| | 17 | balance | 1.95 | 0.75 | 0.74 | — | 2.70 |
| | 18 | balance | 2.20 | 0.95 | 0.85 | — | 3.15 |
| | 19 | balance | 2.35 | 1.15 | 0.84 | — | 3.50 |
| | 20 | balance | 2.30 | 1.20 | 0.75 | Mg: 0.04, Zn: 0.05 | 3.50 |
| Comparative Example | 31 | balance | 2.55 | 1.20 | 0.95 | — | 3.75 |
| | 32 | balance | 1.55 | 1.75 | 0.86 | — | 3.30 |
| | 33 | balance | 2.35 | 1.55 | 1.05 | Zr:0.03, S: 0.01 | 3.90 |
| | 34 | balance | 2.35 | 1.45 | 0.80 | Zn: 0.13 | 3.80 |
| | 35 | balance | 2.05 | 1.45 | 0.83 | — | 3.50 |
| | 36 | balance | 1.75 | 1.35 | 0.82 | — | 3.10 |
| | 37 | balance | 2.35 | 1.25 | 0.87 | — | 3.60 |
| | 38 | balance | 2.85 | 1.75 | 1.12 | — | 4.60 |
| | 39 | balance | 2.15 | 1.75 | 0.82 | Cr: 0.03, Nb: 0.01, Hf: 0.02 | 3.90 |
| | 40 | balance | 1.55 | 0.55 | 0.55 | — | 2.10 |
| | 41 | balance | 1.80 | 1.35 | 0.82 | Sn: 0.9 | 3.15 |
| | 42 | balance | 1.20 | 2.65 | 1.65 | — | 3.85 |
| | 43 | balance | 2.20 | 1.05 | 0.72 | Mg: 0.05 | 3.25 |

The underlined values are outside the scope of the invention.

TABLE 2

| | | Thermal history before aging | | | | | | | | | |
|---|---|---|---|---|---|---|---|---|---|---|---|
| | | Heat and maintaining cast piece | | Solid solution heat treatment | | Maintaining after solid solution treatment | | Aging treatment | | | Finishing cold |
| Class | No. | Temperature (° C.) | Time (h) | Temperature (° C.) | Time (min) | Temperature (° C.) | Time (sec) | Temperature (° C.) | Time (h) | ECage/ECmax | rolling ratio (%) |
| Example of Invention | 1 | 1030 | 3 | 1000 | 1 | 700 | 52 | 375 | 7 | 0.68 | 35 |
| | 2 | 1030 | 3 | 980 | 1 | 700 | 52 | 350 | 5 | 0.73 | 40 |
| | 3 | 1030 | 3 | 990 | 1 | 700 | 52 | 350 | 5 | 0.71 | 50 |
| | 4 | 1030 | 3 | 975 | 1 | 700 | 52 | 350 | 5 | 0.75 | 35 |
| | 5 | 1030 | 3 | 970 | 1 | 700 | 52 | 350 | 5 | 0.72 | 35 |
| | 6 | 1030 | 3 | 1000 | 1 | 700 | 52 | 350 | 5 | 0.68 | 45 |
| | 7 | 1030 | 3 | 975 | 1 | 700 | 52 | 350 | 5 | 0.74 | 40 |
| | 8 | 1030 | 3 | 965 | 1 | 700 | 52 | 375 | 5 | 0.75 | 40 |
| | 9 | 1030 | 3 | 980 | 1 | 700 | 52 | 350 | 5 | 0.76 | 40 |
| | 10 | 1030 | 3 | 1010 | 1 | 700 | 52 | 375 | 7 | 0.76 | 35 |
| | 11 | 1030 | 3 | 1015 | 1 | 700 | 52 | 350 | 5 | 0.71 | 30 |
| | 12 | 1030 | 3 | 1010 | 1 | 700 | 52 | 350 | 5 | 0.73 | 50 |
| | 13 | 1030 | 3 | 980 | 1 | 700 | 52 | 350 | 5 | 0.70 | 40 |
| | 14 | 1030 | 3 | 1000 | 1 | 700 | 52 | 350 | 5 | 0.69 | 40 |
| | 15 | 1030 | 3 | 1000 | 1 | 700 | 52 | 375 | 5 | 0.79 | 35 |
| | 16 | 1030 | 3 | 980 | 1 | 700 | 52 | 350 | 5 | 0.65 | 22 |
| | 17 | 1030 | 3 | 975 | 1 | 700 | 52 | 375 | 5 | 0.69 | 45 |
| | 18 | 1030 | 3 | 975 | 1 | 620 | 52 | 375 | 5 | 0.62 | 40 |
| | 19 | 1030 | 3 | 1000 | 1 | 780 | 52 | 375 | 5 | 0.71 | 45 |
| | 20 | 1030 | 3 | 970 | 1 | 700 | 52 | 325 | 5 | 0.61 | 45 |
| Comparative Example | 31 | 950 | 3 | 970 | 1 | 700 | 52 | 350 | 5 | 0.75 | 35 |
| | 32 | 1030 | 3 | 980 | 1 | (none) | | 375 | 10 | 0.38 | 40 |
| | 33 | 1030 | 3 | 970 | 1 | 700 | 52 | 325 | 5 | 0.72 | 40 |
| | 34 | 1030 | 3 | 1000 | 1 | 700 | 52 | 500 | 5 | 0.89 | 40 |
| | 35 | 1030 | 1 | 975 | 1 | 700 | 52 | 350 | 1 | 0.45 | 40 |
| | 36 | 1080 | 1 | (unable to proceed to next step and terminated due to cracking in hot rolling) | | | | | | | |
| | 37 | 1030 | 3 | 800 | 1 | 700 | 52 | 325 | 3 | 0.78 | 35 |
| | 38 | 1030 | 3 | 1010 | 5 | 700 | 52 | 325 | 5 | 0.75 | 40 |
| | 39 | 1030 | 3 | 1010 | 1 | 700 | 52 | 375 | 7 | 0.93 | 40 |
| | 40 | 1030 | 3 | 965 | 1 | 700 | 52 | 350 | 5 | 0.69 | 35 |
| | 41 | 1030 | 3 | 980 | 1 | 700 | 52 | 350 | 5 | 0.71 | 40 |
| | 42 | 1030 | 3 | 1010 | 5 | 700 | 52 | 350 | 5 | 0.62 | 35 |
| | 43 | 1030 | 3 | 980 | 1 | 700 | 52 | 450 | 5 | 0.90 | 40 |

The underlined values are outside the scope of the invention.

A disk having a diameter of 3 mm was punched out from the test material, and a specimen for TEM observation was produced by a twin jet polishing method. Micrographs for 10 view fields arbitrarily selected were obtained with TEM at an acceleration voltage of 200 kV and a magnification of 100,000, on which the number of fine secondary phase particles having a particle diameter of from 5 to 10 nm was counted, and the total number thereof was divided by the total area of the observed field to provide the number density of the fine secondary phase particles (per $mm^2$). The particle diameter of the particle was the diameter of the minimum circle surrounding the particle.

In the observation with TEM, the portion of the Cu parent phase was irradiated with an electron beam having an acceleration voltage of 200 kV by using an EDS (energy dispersive X-ray spectrometry) equipment attached to the TEM, so as to perform quantitative analysis. In the case where the Cu concentration (% by mass) obtained as an EDS analysis result was lower than (100−(actual total percentage by mass of the alloy elements other than Cu)), the EDS analysis value was not used since the EDS analysis value was subjected to influence of the secondary phase particles, and the average value of Si analysis values (% by mass) in the EDS analysis values of 10 positions in the other cases was calculated and designated as the Si concentration (% by mass) in the parent phase of the specimen, as described above.

A rolled surface of a specimen collected from the test material was electrochemically polished to dissolve only the Cu parent phase (matrix) to produce a specimen for observation having the secondary phase particles exposed to the surface. Micrographs for 20 view fields arbitrarily selected were obtained with SEM at a magnification of 3,000, on which the number of coarse secondary phase particles having a particle diameter of from 5 μm or more was counted, and the total number thereof was divided by the total area of the observed field to provide the number density of the coarse secondary phase particles (per $mm^2$). The particle diameter of the particle was the diameter of the minimum circle surrounding the particle.

A specimen obtained by polishing and then etching a rolled surface of a specimen collected from the test material was observed with an optical microscope, and the average crystal grain diameter was obtained by the Intercept Method of JIS H0501. The twin boundary was not considered as the crystal grain boundary.

The conductivity of the test material was obtained according to JIS H0505.

A specimen for tensile test in the rolling direction (LD) (test specimen #5 according to JIS Z2241) was produced from the test material. Three specimens for each of the test materials were subjected to a tensile test according to JIS Z2241 to measure the 0.2% offset yield strength, and the average value thereof was designated as the 0.2% offset yield strength of the test material.

The press punching property was evaluated in the following manner. A specimen collected from the test material was subjected to a press punching test with a clearance of approximately 7% by using a circular punch having a punch diameter of 10.00 mm and a hole diameter of the die of 10.02 mm. The press condition was a pressing speed of 1 mm/min without a lubricant, and the test was performed 10 times per one specimen. The material remaining after punching out the hole having a diameter of 10 mm was observed with an optical microscope on the cross section that is perpendicular to the punched surface and in parallel to the thickness direction of the sheet, so as to measure the gouge depth. The specimen for observation was measured for 8 positions, which were arbitrarily selected from the cross section in parallel to the rolling direction for 4 positions and from the cross section perpendicular to the rolling direction for 4 positions. FIG. 1 schematically shows the cross sectional shape of the specimen, in which T represents the sheet thickness, and a represents the gouge depth. The gouge depth was evaluated in such a manner that a material with no material having an a/T ratio exceeding 7% was evaluated as ○ (passed), and a material with one or more material having an a/T ratio exceeding 7% was evaluated as X (failed).

The stress relaxation resistance property were evaluated in the following manner. A specimen for bending (width: 10 mm) having a longitudinal direction in TD (i.e., the direction perpendicular to the rolling direction and the thickness direction) was collected from the test material, and the specimen was bent into an arch shape and fixed in such a state that the surface stress at the center portion in the longitudinal direction of the specimen was 80% of the 0.2% offset yield strength. The surface stress (MPa) is determined by the expression, (surface stress)$=6Et\delta/L_0^2$, wherein E represents the elastic coefficient (MPa) of the specimen, t represents the thickness (mm) thereof, and δ represents the warp height (mm) thereof. The specimen bent into an arch shape was maintained in the air at a temperature of 150° C. for 1,000 hours, and then the stress relaxation ratio was calculated from the warpage of the specimen. A specimen having a stress relaxation ratio of 5.0% or less is determined as a specimen that has favorable stress relaxation resistance characteristics in a purpose assuming the use under a high temperature environment, such as an automobile member. The stress relaxation ratio is determined by the expression, (stress relaxation ratio (%))$=((L_1-L_2)/(L_1-L_0))\times 100$, wherein $L_0$ represents the horizontal distance (mm) between the ends of the specimen having been bent into an arch shape and fixed, $L_1$ represents the length (mm) of the specimen before bending, and $L_2$ represents the horizontal distance (mm) between the ends of the specimen having been bent into an arch shape and heated.

The results are shown in Table 3.

TABLE 3

| Class | No. | Secondry phase particles: Coarse particles of ≥5 μm ( /mm²) | Secondry phase particles: Fine particles of 5 to 10 nm (×10⁹/mm²) | Si concentration in parent phase (% by mass) | Average crystal grain diameter (μm) | 0.2% offset yield strength (MPa) | Conductivity (% IACS) | Evaluation of press punching property | Stress relaxation ratio TD (%) |
|---|---|---|---|---|---|---|---|---|---|
| Example of invention | 1 | 4.7 | 4.0 | 0.36 | 15 | 1036 | 36 | ○ | 3.1 |
| | 2 | 0.0 | 2.6 | 0.24 | 13 | 1019 | 41 | ○ | 3.8 |
| | 3 | 4.7 | 3.0 | 0.28 | 14 | 1029 | 38 | ○ | 3.5 |
| | 4 | 0.0 | 2.6 | 0.21 | 13 | 1002 | 41 | ○ | 4.3 |
| | 5 | 4.7 | 2.9 | 0.25 | 11 | 1006 | 40 | ○ | 4.1 |
| | 6 | 0.0 | 2.6 | 0.28 | 17 | 1018 | 42 | ○ | 3.1 |
| | 7 | 4.7 | 2.6 | 0.22 | 12 | 1005 | 41 | ○ | 4.2 |
| | 8 | 4.7 | 3.6 | 0.25 | 10 | 1031 | 42 | ○ | 4.5 |
| | 9 | 4.7 | 2.6 | 0.21 | 12 | 995 | 43 | ○ | 4.3 |
| | 10 | 0.0 | 2.7 | 0.25 | 19 | 1003 | 43 | ○ | 3.2 |
| | 11 | 0.0 | 2.2 | 0.19 | 21 | 983 | 38 | ○ | 3.7 |
| | 12 | 4.7 | 2.6 | 0.23 | 17 | 1016 | 41 | ○ | 4.0 |
| | 13 | 9.4 | 2.5 | 0.27 | 12 | 1005 | 42 | ○ | 3.8 |
| | 14 | 4.7 | 1.9 | 0.25 | 18 | 987 | 43 | ○ | 3.4 |
| | 15 | 0.0 | 2.4 | 0.13 | 17 | 986 | 45 | ○ | 4.9 |
| | 16 | 0.0 | 2.9 | 0.33 | 13 | 991 | 38 | ○ | 3.2 |
| | 17 | 0.0 | 1.7 | 0.23 | 16 | 987 | 42 | ○ | 3.4 |
| | 18 | 0.0 | 2.2 | 0.32 | 14 | 998 | 37 | ○ | 3.7 |
| | 19 | 4.7 | 2.4 | 0.24 | 17 | 1008 | 42 | ○ | 3.5 |
| | 20 | 0.0 | 1.3 | 0.29 | 12 | 994 | 40 | ○ | 3.7 |
| Comparative Example | 31 | 93.7 | 0.6 | 0.24 | 11 | 935 | 41 | X | 4.3 |
| | 32 | 4.7 | 0.3 | 0.53 | 12 | 931 | 26 | ○ | 2.8 |
| | 33 | 149.9 | 0.7 | 0.27 | 9 | 958 | 39 | X | 4.2 |
| | 34 | 4.7 | 0.4 | 0.09 | 16 | 900 | 54 | ○ | 8.2 |
| | 35 | 154.6 | 0.7 | 0.48 | 12 | 939 | 30 | X | 3.0 |
| | 36 | — | — | — | — | — | — | — | — |
| | 37 | 4.7 | 0.2 | 0.19 | 3 | 903 | 45 | ○ | 9.8 |
| | 38 | 126.5 | 0.8 | 0.28 | 7 | 975 | 37 | X | 5.0 |
| | 39 | 187.4 | 0.8 | 0.07 | 16 | 912 | 56 | X | 9.2 |
| | 40 | 0.0 | 0.3 | 0.17 | 19 | 908 | 50 | ○ | 4.2 |
| | 41 | 0.0 | 2.3 | 0.24 | 14 | 989 | 26 | ○ | 3.8 |
| | 42 | 135.9 | 0.5 | 0.63 | 7 | 962 | 27 | X | 4.2 |
| | 43 | 0.0 | 1.5 | 0.05 | 19 | 960 | 58 | ○ | 8.4 |

The underlined values are outside the scope of the invention.

The specimens of the examples of the invention provided a significantly high strength level of a 0.2% offset yield strength of 980 MPa or more, and further 1,000 MPa or more, due to the enhancement of the work hardening capability with Si remaining in the parent phase. The specimens were also excellent in the conductivity, the press punching property and the stress relaxation resistance characteristics.

On the other hand, the specimen No. 31 was low in the heating and maintaining temperature of the cast piece, and thus underwent a large amount of the coarse secondary phase particles remaining and was inferior in the press punching property. The specimen failed to ensure a sufficient formation amount of the fine secondary phase particles and provided a low strength.

The specimen No. 32 did not undergo a thermal history of maintaining to from 600 to 800° C. after the solid solution treatment. The specimen thus was insufficient in the precipitation of the fine secondary phase particles and was inferior in the strength and the conductivity.

The specimen No. 33 had large contents of Zr and S and as a result, a large amount of coarse crystalized products were formed on casting. The specimen thus failed to form a solid solution sufficiently in the process before the aging treatment, and the specimen underwent a large amount of the coarse secondary phase particles remained, and was insufficient in the formation amount of the fine secondary phase particles. Accordingly, the specimen was inferior in the press punching property and had a low strength.

The specimen No. 34 was high in the aging treatment temperature, and thus the specimen underwent a small amount of the fine secondary phase particles formed and had a low strength. The specimen had a low Si content in the parent phase, and thus was inferior in the strength and the stress relaxation resistance characteristics, as compared to the specimen No. 32 as a comparative example having the amount of the fine secondary phase particles that was equivalent thereto.

The specimen No. 35 was short in the heating and maintaining time of the cast piece, and thus the specimen had a microstructure of the material containing a large amount of the coarse d secondary phase particles and was inferior in the press punching property. The specimen was insufficient in the precipitation of the fine secondary phase particles and had a low strength.

The specimen No. 36 was high in the heating and maintaining temperature of the cast piece, and thus underwent cracking in the hot rolling, thereby failing to proceed to the next step.

The specimen No. 37 was low in the solid solution heat treatment temperature, and the fine secondary phase particles were not sufficiently precipitated in the aging treatment. Accordingly, the specimen had a low strength and was inferior in the stress relaxation resistance property.

The specimen No. 38 had a large total content of Ni and Co, and thus the specimen failed to form sufficiently a solid solution of the coarse secondary phase particles in the process before the aging treatment, and was insufficient in the enhancement of the strength and the improvement of the press workability.

The specimen No. 39 had large contents of Cr, Nb and Hf, and thus coarse crystalized products were formed in a large amount on casting, the fine secondary phase particles were not sufficiently precipitated in the aging treatment, and the Si concentration in the parent phase was low. Accordingly, the specimen was inferior in the strength and the stress relaxation resistance property, as compared to the specimens Nos. 33, 35 and 38 as comparative examples having the number density of the fine secondary phase particles that was equivalent thereto.

The specimen No. 40 had a small content of Si, and thus the specimen was insufficient in the formation of the fine secondary phase particles and had a low strength.

The specimen No. 41 had a large content of Sn, and thus had a low conductivity.

The specimen No. 42 had large contents of Co and Si, and the specimen contained a large amount of the coarse secondary phase particles and failed to ensure the sufficient amount of the fine secondary phase particles. Accordingly, the specimen was inferior in the strength and the press punching property.

The specimen No. 43 had a proper precipitation amount of the fine secondary phase particles, but had a low Si concentration in the parent phase, and thus the specimen was insufficient in the enhancement of the strength due to the work hardening to provide a low strength level.

The invention claimed is:

1. A copper alloy sheet material comprising a chemical composition containing from 2.50 to 4.00% in total of Ni and Co, from 0.50 to 2.00% of Co, from 0.70 to 1.50% of Si, from 0 to 0.50% of Fe, from 0 to 0.10% of Mg, from 0 to 0.50% of Sn, from 0 to 0.15% of Zn, from 0 to 0.07% of B, from 0 to 0.10% of P, from 0 to 0.10% of REM (rare earth elements), from 0 to 0.01% in total of Cr, Zr, Hf, Nb and S, the balance of Cu, and unavoidable impurities, all in terms of percentage by mass; containing secondary phase particles present in a parent phase, in which a number density of coarse secondary phase particles having a particle diameter of 5 μm or more is 10 per $mm^2$ or less, and a number density of fine secondary phase particles having a particle diameter of from 5 to 10 nm is $1.0\times10^9$ per $mm^2$ or more; and having an SI concentration in the parent phase of 0.10% by mass or more and 0.50% by mass or less.

2. The copper alloy sheet material according to claim 1, wherein the copper alloy sheet material has a 0.2% offset yield strength of 980 MPa or more in a rolling direction and a conductivity of 30% IACS or more.

3. A current carrying component, which is one of a connector, a lead frame, a relay and a switch, produced by using a member obtained by press punching the copper alloy sheet material according to claim 1.

* * * * *